US005535528A

United States Patent [19]

Finkam

[11] Patent Number: 5,535,528

[45] Date of Patent: Jul. 16, 1996

[54] AGGLOMERATING WASTE SLUDGE AND YARD WASTE

[75] Inventor: Joseph E. Finkam, Dayton, Ohio

[73] Assignee: By-Product Solutions, Inc., Westfield, Ind.

[21] Appl. No.: 189,788

[22] Filed: Feb. 1, 1994

[51] Int. Cl.[6] ..... F26B 7/00

[52] U.S. Cl. ..... 34/378; 34/379

[58] Field of Search ..... 34/380, 381, 384, 34/386, 387, 388, 379, 333, 376–378

[56] References Cited

U.S. PATENT DOCUMENTS

| | | | |
|---|---|---|---|
| 2,438,450 | 3/1948 | Nelson | 34/378 |
| 4,599,954 | 7/1986 | Williams | 110/346 |
| 4,829,678 | 5/1989 | Glorioso | 34/378 |
| 4,886,000 | 12/1989 | Holter et al. | 110/226 |
| 4,938,155 | 7/1990 | Williams | 110/224 |
| 4,989,344 | 2/1991 | Glorioso | 34/378 |
| 5,069,801 | 12/1991 | Girovich | 34/378 |
| 5,215,670 | 6/1993 | Girovich | 34/378 |
| 5,271,162 | 12/1993 | Kunz et al. | 34/27 |

*Primary Examiner*—Henry A. Bennet
*Assistant Examiner*—Susanne C. Tinker
*Attorney, Agent, or Firm*—Woodard, Emhardt, Naughton, Moriarty & McNett

[57] ABSTRACT

A process and apparatus which mixes yard waste and municipal waste sludge to form fuel, fertilizer, or animal feed supplement. The yard waste and sludge are thoroughly mixed in a mixer and fed into a thermal dryer. A portion of the dried material is then fed back to the mixer to raise the solids content of the mixture entering the dryer and control the solids content of the mixture exiting the dryer. It is preferable to reduce the particle size of the yard waste to shreds or to the consistency of a meal before mixing with the sludge. Yard waste considered usable in this invention is grass, leaves, wood from pallets, and waste grains.

12 Claims, 1 Drawing Sheet

AGGLOMERATING WASTE SLUDGE AND YARD WASTE

BACKGROUND OF THE INVENTION

This invention most generally pertains to the drying of waste sludge, and more particularly pertains to the drying of waste sludge where yard waste is mixed with the waste sludge before drying.

Municipal treatment of waste water creates large amounts of waste sludge. Waste sludge is what remains after the treatment of waste water by a number of known methods. Though water is recycled back to society, typically waste sludge is not and must be disposed in a safe, efficient manner. A few known examples of disposal methods are: by direct application onto land, by composting, by land filling, or by drying and incinerating the solids.

In November 1992, new laws were passed establishing governmental controls on sludge disposition. Sludges must now have at least 30% solids and have a complete pathogen kill before their disposal. Given these restrictions and the ever increasing cost of landfill space, it has become quite difficult for cities and businesses to discard sludge. What is needed are improved methods to recycle this waste.

A known alternative is burning sludge to produce heat. Waste sludge is readily combustible when it is dry. Normally in such procedures, the sludge is dried in a dryer and burned in a furnace where the off gas is passed through a heat exchanger. For an example, see U.S. Pat. No. 4,429,643. In such sludge treatment processes, wet sludge cake has a moisture content of about 80% as it enters the dryer. The moisture is flashed away and the dried product is pelletized. Any off gas from the dryer is mixed with outside air and used as combustion gas in the furnace to dry additional sludge.

In U.S. Pat No. 3,963,471 a process is described for producing uniform pellets in which wet sludge cake from a mechanical dewatering procedure is mixed with previously dried product pellets and the mixture is then cycled back through the dryer. It is described that the size of the pellets can be controlled by the amount of material recycled. The recycled pellets form nucleii for the formation of pellets in the dryer as they are surrounded by an adhering layer of wet sludge cake.

In U.S. Pat. No. 4,040,190 a process is described in which recycled materials are passed through a crusher before being mixed wit a wet sludge cake. In that patent it is indicated that the crushing device may be adjusted for controlling the size of the grains to be supplied to the device and that by crushing to a predetermined size the grain size of the output pellets can be controlled.

The present invention concerns a novel processing option to simultaneously recycle waste sludge and address an additional waste disposal problem. This additional problem is what to do with yard waste and arises because grass and leave clippings, in many cities, can no longer be publicly burned or sent to a landfill.

SUMMARY OF THE INVENTION

In one aspect, this invention is a process for agglomerating sludge with yard waste, comprising the steps of mixing the yard waste and sludge to form a mixture; drying the mixture in a thermal dryer to a substantially constant solids content; conveying the dried mixture from the thermal dryer to a surge bin; and recycling a portion of the dried mixture by mixing the recycled portion with incoming sludge. The dried agglomeration of yard waste and waste sludge is useful as an animal feed supplement, fertilizer, or fuel.

In another aspect, this invention is an apparatus for agglomerating sludge with yard waste, comprising a mixer to receive and thoroughly combine yard waste and sludge to form a mixture; a thermal dryer, downstream of the mixer, to receive and dry the mixture to a substantially constant solids content; a surge bin, downstream of the thermal dryer, to receive the dried mixture and temporarily store it; and a recycle loop to carry a portion of the dried mixture from the thermal dryer or the surge bin to the incoming sludge to increase the solids content of the mixture entering the thermal dryer.

BRIEF DESCRIPTION OF THE DRAWING

In the accompanying drawing, forming a part of the specification.

DESCRIPTION OF THE PREFERRED EMBODIMENT

Figure 1:
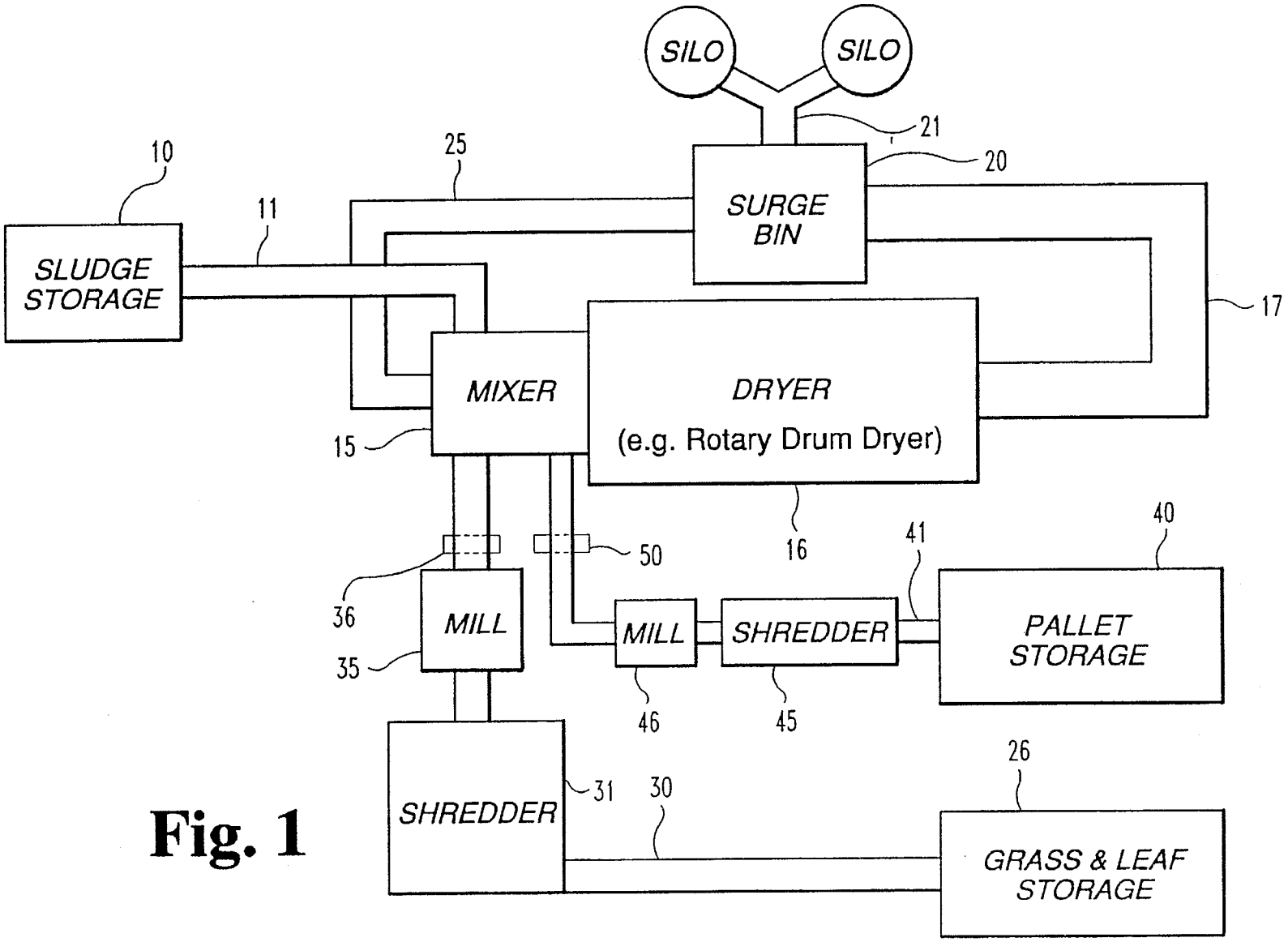
FIG. 1 is a process flow diagram according to one embodiment of this invention.

Specific language is used to describe several embodiments of this invention for the purpose of promoting an understanding of the principles of the invention. However, it must be understood that no limitation of the scope of this invention is intended by using this specific language. Any alteration and further modification of this process or apparatus, and any application of the principles of this invention are also intended that would normally occur to one, skilled in the art to which this invention pertains.

According to one embodiment of the present invention, waste sludge is agglomerated with yard waste and dried to form an aggregate. Initially, waste sludge, incoming to the process, is thoroughly mixed with yard waste to form a mixture. This mixture is then thermally dried until, at the mixture's exit from the thermal dryer, it is from about 70% to about 100% solids by weight of the mixture. The now dried mixture is next conveyed into a storage facility. From the storage facility, a portion of the dried mixture is conveyed back to a point upstream of the dryer where the dried mixture is thoroughly mixed with the incoming sludge or the wet mixture of sludge and yard waste. The dried mixture or aggregate obtained in this process is typically used as animal feed supplement, fertilizer, or fuel.

To promote adequate mixing in the mixing step of this invention, it is preferable to reduce the size the yard waste into smaller pieces. It is preferable to shred the yard waste into broken pieces or shreds before it is mixed with the sludge. Additionally, a second size reduction step is yet more preferable. Particularly, it is more preferable to mill the broken pieces from the shredding step into smaller particles or meal before the yard waste is allowed to combine with the incoming sludge. The smaller pieces or particles created with one or both size reduction steps creates a more homogenous mixture of yard waste and sludge upon mixing.

Aggregate product specifications of yard waste and sludge vary and particularly so in regard to the solids content of the dried mixture. Accordingly, it is very important that this process is capable of varying the moisture level of the dried mixture, no matter what the solids content of the incoming sludge may be. Typical product requirements range from about 70% to about 100% solids by weight of the mixture. However, the solids content of any material entering the thermal dryer must begin at 40% to prevent any sludge from adhering to the dryer's internal walls. Thus, it initially appears that only material between 40% and 100% solids may enter this drying process due to the limitations of tile dryer; and that drying temperature, rate of aeration, or material rate of flow are the only variables available to compensate for moisture variances in incoming sludge or changes in product specifications. However, the present invention is not so limited.

With the aid of a recirculation loop, this process creates a mixture of yard waste and sludge having a uniform solids content, no matter what the moisture level of the incoming sludge or what the product specifications may be. The recirculation loop is incorporated into the present design to allow sludge less than 40% solids to be used in this invention and to improve control over the solids content of the dried product. Particularly, the recirculation loop carries dried material back to the mixer, upstream of the dryer, to combine previously dried material with overly damp material, i.e., sludge and/or yard waste below 40% solids. The recirculated material raises the solids level of the mixture entering the thermal dryer to the 40% level or higher and the mixture then passes through the thermal dryer without difficulty.

The recirculation loop also assists in controlling the solids content of the product. If the product is too damp, a larger portion of dried material is recirculated through the dryer in order to increase the solids content of the exiting product. Simply stated, the mixture of yard waste and sludge is continually recirculated through the dryer until the desired level of solids is achieved. Once this occurs, any entering sludge that is below the 40% minimum is mixed with previously dried material to raise the solids content of the mixture entering the dryer to the 40% minimum or higher. As a result, this process allows sludges, dilute as 1% solids, to be processed with yard waste and dried.

However, it must be remembered that it is generally more economical to mechanically dewater highly dilute sludge before dewatering with a thermal dryer. Mechanical dewatering can be used to raise the solids content near the 40% level before drying. Sludges usually have a solids content of 2–20% solids. Yard waste (grass and leave clippings) usually have a solids content of 7–20% solids. Thus, mechanical dewatering is of benefit to this invention; however, it is not encompassed in the scope of this invention.

Regarding the dryer and the drying step, a typical means for drying the yard waste and sludge mixture includes dryers of the rotary type of which there are many. However, the scope of this invention is not limited by the type of thermal dryer utilized because the selection of a dryer suitable for sludge is well within the known art of sludge processing. Although, an operating characteristic typical of most dryers used in conjunction with this invention is a dryer inlet temperature between 800° F. to 1300° F. and a dryer outlet temperature between 200° F. to 350° F.

An additional key to the success of this process is the manner in which the waste sludge, yard waste, and any recycled material are mixed. If they are not mixed properly, they may separate in the dryer and prevent the whole system from working. Examples of mixing devices that are used in this process generally include those of the paddle wheel type. This mixer has rotating shafts with multiple paddles that mix the waste sludge and yard waste together. Additionally, this process also generally includes mixers of the double screw, auger type. This mixer has two screws intermeshing so that the yard waste and sludge is blended as it passes between the screws. What is critical to practice this invention is that the mixer be capable of thoroughly mixing the materials. It is not critical that a particular type of mixer be used to perform the thorough mixing step of this invention.

Furthermore and to assist the mixing step of this invention, it is preferable that the yard waste be chopped or ground into small pieces to more easily combine with the sludge upon mixing. The yard waste is preferably first sent through a shredder to make an initial size reduction and to break the grass and leaves apart. Furthermore, it is more preferable that a second size reduction be made before mixing with the sludge. The yard waste from the shredder is sent through a mill to grind the yard waste to the consistency of particles resembling saw dust. Afterward, these particles easily combine and thoroughly mix with the waste sludge.

Typically, the yard waste used to practice this invention is comprised of leaves and grass. However, waste grains and wood from pallet boards are also usable. Waste grains are fine particles of grain products, discarded from grainaries and food plants. Pallet boards are the structural members from portable wooden platforms that are used to handle and store materials and packages in warehouses and factories. No matter what form of the yard waste, these materials can only make up only about 50% of the mixture. Otherwise, the mixture of yard waste and sludge will not travel through the dryer properly and ultimately the mixture may not achieve a proper solids content upon exit from the dryer. However, if this 50% level is not exceeded, typically the mixture makes good fuel, fertilizer, or animal feed supplement.

Referring to FIG. 1, there is shown another embodiment of this invention. Incoming sludge is stored at 10 and conveyed 11 to mixer 15. At mixer 15, the incoming sludge is thoroughly combined with grass and leaves, recirculated material, and optionally pallet boards to form a mixture. From mixer 15, this mixture is moved into thermal dryer 16. Thermal dryer 16 is preferably of the rotary type with an inlet temperature between 800° F. and 1300° F. and an outlet temperature between 200° F. and 350° F. Furthermore and at a minimum, the mixture entering dryer 16 is 40% solids by weight of the mixture, to prevent the sludge from adhering to the walls of the dryer. Upon exit, the material is typically dried to between 70% and 100% solids by weight of the mixture and due to the high drying temperatures utilized, the mixture is virtually free of active pathogens as any present are killed.

Upon exit from dryer 16, the dried mixture is conveyed 17 into surge bin 20. From surge bin 20, the dried mixture or dried product is conveyed 21 to storage silos or recirculated 25 to assist in processing incoming sludge. Upon recirculation 25, the previously dried product is mixed in mixer 15 with incoming sludge, yard waste, and optionally pallet boards to achieve at least two goals. A first is to raise the solids content of sludge entering tile dryer in order to achieve the necessary 40% minimum level of solids required before entering the dryer. A second is to further raise the solids content of the dried mixture exiting the dryer. By increasing the amount of already dried material inside the dryer and decreasing the amount of incoming sludge, the dryer will be able to remove more moisture from the mixture given the same amount of material passing through the dryer. Simply stated, more recirculated material passing through the dryer increases the ultimate level of solids in the dried mixture exiting the dryer.

Grass, leaves, or waste grains are stored at 26. These materials are conveyed 30, preferably through a shredder 31 and also preferably through mill 35. The use of these size reduction steps allows the yard waste to uniformly mix with the waste sludge. Magnet 36 is helpful to remove any metallic parts before they might enter the mixer and contaminate the product.

Pallets are stored at 40. The pallets are conveyed 41, shredded 45, and milled 46 similarly as the grass, leaves and waste grains are processed. And although two separate shredding and milling lines are shown, it is also contemplated that the pallets may be processed in the same processing line and even at the same time as the grass and etc. are processed. Magnet 50 is present to remove metallic objects from the pallet boards before they might contaminate the product.

The foregoing process allows for municipalities that currently send much of their waste product to landfills or incinerators, to alternatively recycle their waste sludge and yard waste into animal feed supplement, fertilizer, or fuel.

While the invention has been illustrated and described in detail in the drawing and foregoing description, these are considered illustrative and not restrictive in character. It should be understood that only the preferred embodiment is shown and described, and that all changes and modifications that come within the spirit of the invention are protected.

What is claimed is:

1. A process for agglomerating sludge with yard waste, comprising the steps of:

(a) mixing yard waste and sludge to form a mixture;

(b) drying said mixture in a thermal dryer to a substantially constant solids content;

(c) conveying said dried mixture from the thermal dryer to a surge bin; and (d) recycling a portion of said dried mixture by mixing said portion of said dried mixture with additional sludge and drying the resultant mixture again in a thermal dryer.

2. The process of claim 1, further comprising the step of shredding the yard waste before said mixing, whereby the yard waste is broken into small pieces.

3. The process of claim 1, further comprising the step of milling the yard waste before said mixing, whereby the yard waste is ground into meal.

4. The process of claim 1, wherein the thermal dryer is a rotary drum dryer.

5. The process of claim 1, wherein a temperature is reached, inside the thermal dryer, effective to substantially kill all the pathogens present in said mixture.

6. The process of claim 1, wherein the solids content of the mixture entering the thermal dryer is no less than 40% by weight of the mixture.

7. The process of claim 1, wherein the solids content of the mixture exiting the thermal dryer is from about 50% to about 100% by weight of the mixture.

8. The process of claim 1, wherein the yard waste is comprised of grass, leaves, sticks, shrubs, bushes, or weeds.

9. The process of claim 1, wherein tile yard waste is comprised of waste grains.

10. The process of claim 1, wherein the yard waste is no greater than 50% by weight of the mixture.

11. The process of claim 1, wherein the yard waste is comprised of pallet boards.

12. A process for agglomerating sludge with yard waste, comprising the steps of:

(a) mixing yard waste and sludge to form a mixture;

(b) drying said mixture ha a thermal dryer to a substantially constant solids content;

(c) conveying said dried mixture from the thermal dryer to a surge bin; and (d) recycling a portion of said dried mixture by mixing said portion of said dried mixture with additional sludge and drying the resultant mixture again in a thermal dryer;

wherein said sludge is dilute as 1% solids.

* * * * *